US006601678B2

(12) United States Patent
Kostka et al.

(10) Patent No.: US 6,601,678 B2
(45) Date of Patent: Aug. 5, 2003

(54) METHOD OF ALLOCATING ELEVATOR CARS TO OPERATING GROUPS OF A DESTINATION CALL CONTROL

(75) Inventors: Miroslav Kostka, Ballwil (CH); Viktor Wunderlin, Kriens (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/073,729

(22) Filed: Feb. 11, 2002

(65) Prior Publication Data

US 2002/0129994 A1 Sep. 19, 2002

(30) Foreign Application Priority Data

Feb. 12, 2001 (EP) ..... 01810144

(51) Int. Cl.[7] ..... B66B 1/20
(52) U.S. Cl. ..... 187/383; 187/388
(58) Field of Search ..... 187/382, 383, 187/384, 388

(56) References Cited

U.S. PATENT DOCUMENTS 3,504,771 A * 4/1970 Suozzo et al. ..... 187/383
3,572,470 A * 3/1971 Hirsch et al. ..... 187/383
3,587,786 A * 6/1971 Savino ..... 187/383
4,007,812 A * 2/1977 Nelson, Jr. ..... 187/383
4,895,223 A * 1/1990 Ekholm et al. ..... 187/383
5,083,640 A 1/1992 Tsuji
5,092,430 A * 3/1992 Goto et al. ..... 187/384
5,285,028 A 2/1994 Umeda et al.
5,300,739 A * 4/1994 Bittar ..... 187/385
5,511,634 A 4/1996 Bahjat et al.
5,883,343 A * 3/1999 MacDonald et al. ..... 187/383
5,969,304 A 10/1999 Barker et al.

FOREIGN PATENT DOCUMENTS

EP 0 452 225 10/1991
EP 0 624 540 3/1999

* cited by examiner

*Primary Examiner*—Jonathan Salata
(74) *Attorney, Agent, or Firm*—MacMillan, Sobanski & Todd, LLC

(57) ABSTRACT

A method of allocating elevator cars to operating groups in which the cars execute travel tasks for specific zones. For example, each elevator car can be assigned to an operating group (EXP) for long-distance trips, an operating group (LOC) for local trips, or a group (FREE) for free elevator cars. If a travel task passes through a blind zone, the most favorable elevator car is selected from the EXP operating group or the FREE group. If the selected elevator car belongs to the FREE group, the car is allocated to the EXP operating group while taking account of certain parameters. If a travel task does not pass through a blind zone, the most favorable elevator car is selected from the LOC operating group or from the FREE group. If the selected elevator car belongs to the FREE group, the car is allocated to the LOC operating group, while taking account of certain parameters. On expiry of a specified time with no travel task, an elevator car of the EXP and LOC operating groups is allocated to the FREE group.

19 Claims, 5 Drawing Sheets

METHOD OF ALLOCATING ELEVATOR CARS TO OPERATING GROUPS OF A DESTINATION CALL CONTROL

BACKGROUND OF THE INVENTION

The present invention relates to a method of allocating elevator cars to operating groups of a destination call control, the elevator cars of an operating group executing travel tasks for specific zones.

An elevator installation for operation by zone is shown in European patent specification EP 0 624 540 B1. In the case of this elevator installation with immediate assignment of zone calls, the passenger traffic between at least one main stop and zones in a tall building is managed by an elevator installation comprising three elevators. Each elevator user entering the building passes a gate which is assigned to a zone and in which a sensor registers the elevator user. By selecting the corresponding gate, the elevator user communicates his/her desired zone to the elevator control without manually operating a call registering device. The signals of the sensors are transmitted to the control devices of the elevators, which control devices in turn communicate to the elevator user by means of a display device the respectively allocated elevator before the user leaves the selected gate.

A disadvantage of this device is that the elevator cars travel to specific, permanently allocated zones. To reach a specific floor, the user must change from the elevator car serving the zone to an elevator car serving the floor.

The U.S. Pat. No. 5,969,304 shows an elevator installation with different elevator groups. A first elevator up can, on account of the physical configuration, only serve the lower floors. A second elevator group can, on account of the physical configuration, only serve the upper floors. A third elevator group serves the upper floors via an express zone, it being possible also to serve travel tasks of the second group.

A disadvantage of this elevator installation is that the elevators are not available for any and all travel tasks. The design of such an elevator installation is difficult and unpractical. The assignment of travel tasks to individual elevators largely corresponds to the physical configuration of the elevator group.

SUMMARY OF THE INVENTION

It is here that the present invention sets out to provide a remedy. The present invention provides a solution to avoiding the disadvantages of the known device and specifying a method which causes automatic adaptation of the elevator group to the traffic conditions in the building.

The present invention concerns a method of allocating a plurality of elevator cars to operating groups of a destination call control, the elevator cars of an operating group executing travel tasks for specific zones or floors, comprising the steps of: a. providing an operating group (EXP) for long-distance trips, an operating group (LOC) for local trips, and a group (FREE) for free elevator cars; b. dynamically allocating each elevator car of a plurality of elevator cars to one of the groups; and c. responding to an occurrence of a travel task by re-allocating one of the cars previously allocated to one of the groups to one of the EXP and LOC operating groups to perform the travel task.

The advantages achieved by the invention are essentially that the transportation performance of the elevator group is improved, and the number of stops as well as the waiting times and starting intervals are optimized. When, for example, up-peak traffic conditions prevail, all elevator cars can be allocated to zone (long-distance trip) operation. If, for example, in the upper area of the building inter-floor traffic is registered, some of the elevator cars are allocated to floor (local trip) operation. The inclusion of an elevator car in a particular operating group can be determined by parameters such as, for example, the waiting time of the elevator car. For elevator cars in floor operation, the waiting times can be selected to be shorter than for elevator cars in zone operation. If an elevator car is taskless, after expiry of a settable time it can be allocated to another operating group. An elevator car can be allocated to the operating group for long-distance trips, or to the operating group for local trips, or to the group for free elevator cars. An elevator car allocated to a specific operating group can temporarily also accept travel tasks of another operating group if this aids traffic optimization. With the method according to the invention an optimal allocation of each elevator car is achieved, efficient operation being assured during both stable traffic and peak traffic.

Elevator users need only communicate their destination floor to the control according to the present invention. The elevator users automatically have allocated to them the elevator car with the most optimal travel conditions. They do not need knowledge of the travel route and/or the most optimal allocation of the elevator car. The elevator car allocated takes them to their desired floor without changing. The elevator users need not know the allocation of the elevator cars to individual operating groups, since the destination calls are automatically allocated to the most favorable elevator car of the respective operating group. Based on the principle of cost calculation, the destination call control can execute an optimal allocation of the elevator cars to the individual operating groups according to the individual destination calls.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
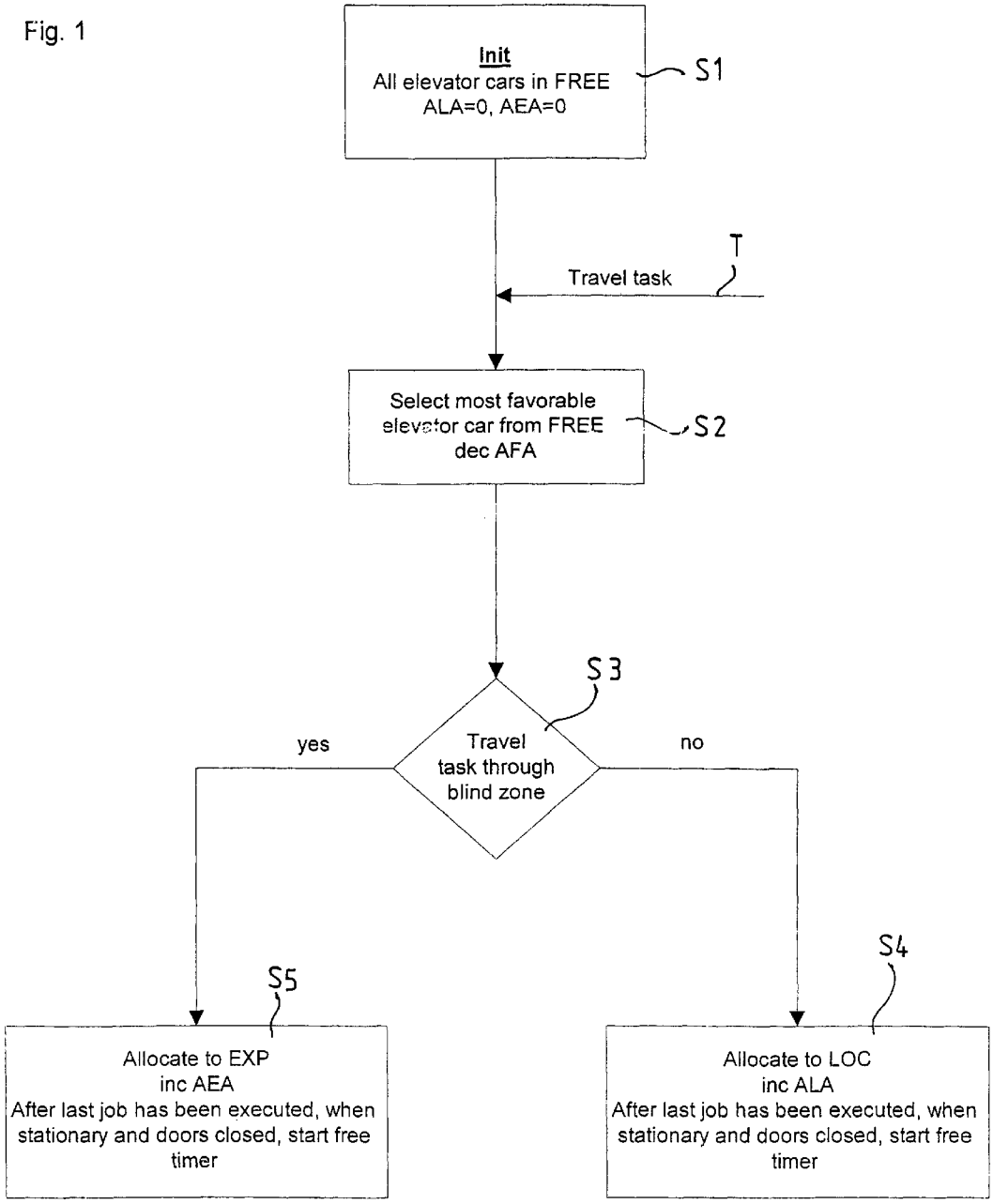
FIG. 1 is a flow diagram of an allocation algorithm according to the present invention for the case that all elevator cars are available to the group for free elevator cars.

The following terms are used in the flowcharts of FIGS. 1 through 4:

AFA—quantity counter to count the free elevator cars

AEA—quantity counter to count the elevator cars allocated to the operating group for long-distance trips ALA—quantity counter to count the elevator cars allocated to the operating group for local trips DWE—average waiting time until execution of a travel task in the operating group for long-distance trips DWL—average waiting time until execution of a travel task in the operating group for local trips EXP—operating group for long-distance trips: the elevator cars serve travel tasks having a blind zone (i.e. at least one floor with no stop) lying between the start and destination of the travel task, or having a great distance between start and destination LOC—operating group for local trips: the elevator cars serve travel tasks with no blind zone, or serve travel tasks over shorter travel distances FREE—group of free elevator cars, which can be allocated to the EXP or LOC operating groups if needed OGVAA—upper limit value of the ratio of the number of elevator cars OGVDW—upper limit value of the ratio of the average waiting time UGVAA—lower limit value of the ratio of the number of elevator cars UGVDW—lower limit value of the ratio of the average waiting time Free timer—time counter to measure the time an elevator car is without a travel task dec—reduce quantity counter (AFA, ALA, AEA) by one unit inc—increase quantity counter (AFA, ALA, AEA) by one unit Blind zone—at least one floor with no stop The average waiting time until execution of a travel task in a specific operating group is, for example, determined for the last five minutes.

As long as the group for free elevator cars still has elevator cars available, the status of the quantity counters AEA and ALA is taken into account in allocating the travel tasks to the operating group for long-distance trips, or to the operating group for local trips. Depending on the building and the specific travel pattern, and the number and size of the elevator groups, values are selected for the parameters AEA and ALA. For example, for an elevator group with eight elevator cars, the value six is selected for AEA and ALA. As soon as the quota of an operating group is exhausted, no further elevator cars may be allocated to this operating group. To balance the ratio AEA/ALA as far as possible, elevator cars from the group for free elevator cars can be allocated to an operating group having too few elevator cars.

If the group for free elevator cars has no more free elevator cars available, the ratio of the average waiting times is checked. Depending on the specific traffic pattern, an upper limit value and a lower limit value are set as parameters. For example, if the ratio AEA/ALA is large, and at the same time the ratio DWE/DWL reaches the lower limit, then the most suitable elevator car of the long-distance operating group can be allocated to the local-trip operating group.

So that elevator cars are not constantly transferred, values are given to the ratios AEA/ALA and DWE/DWL as boundary conditions, the values being selected depending on the elevator group and the size of the operating group. Furthermore, these values can also be selected depending on the respective traffic pattern, the values being set, for example, manually, or time-dependently, or by an expert system. Thus, the method of dynamic allocation of the elevator cars according to the present invention is based upon one or more of the above-described dynamic parameters; a) average waiting times DWE and DWL; b) status of the guantity counters AEA and ALA; c) ratio of the average waiting times of the operating groups DWE/DWL; and d) ratio of the status of the quantity counters of the operating groups AEA/ALA.

FIG. 1 shows an operating method (starting condition) according to the present invention in which all available elevator cars are available to the group for free elevator cars FREE. In a step S1, the quantity counters AEA and ALA are set to zero and the quantity counter AFA is set to the number of elevator cars for the group for free elevator cars FREE. After receipt of a travel task T, the most favorable elevator car from the group for free elevator cars FREE is selected in a step S2. The group for free elevator cars FREE now has one elevator car less available and the quantity counter AFA is reduced by one unit. Following this, in a step S3, a check is made whether a blind zone lies between the start and the destination of the travel task. If the trip does not pass through a blind zone, the method branches at "no" to a step S4 wherein the selected elevator car is allocated to the local-trip (LOC) operating group, and the quantity counter ALA is increased by one unit. If the trip passes through a blind zone, the method branches at "yes" to a step S5 wherein the selected elevator car is allocated to the long-distance (EXP) operating group, and the quantity counter AEA is increased by one unit. In both cases, after the travel task has been executed, the free timer is started.

Figure 2A:
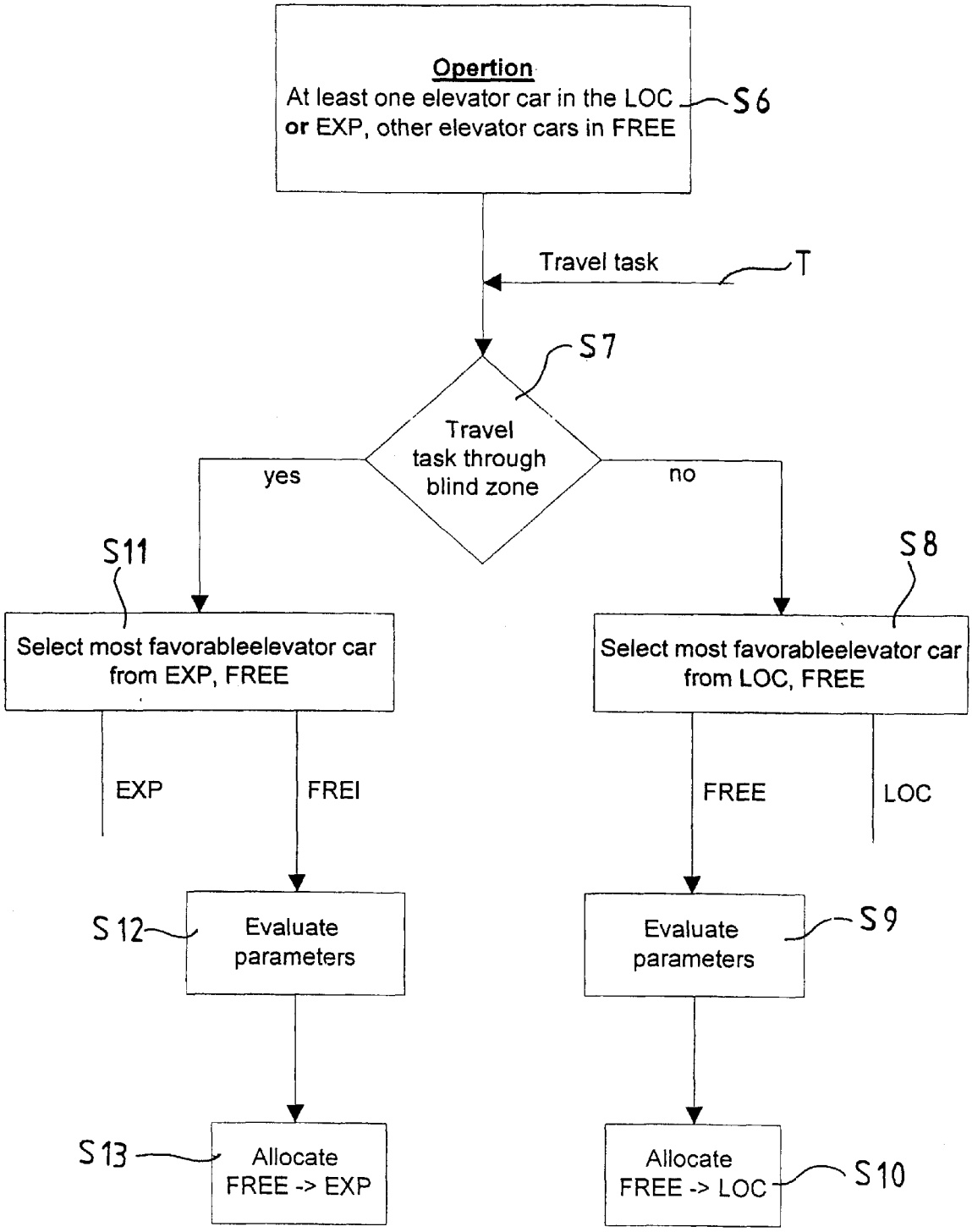
FIG. 2A is a flow diagram of an algorithm according to the present invention for allocation of elevator cars to operating groups.
Figure 2B:
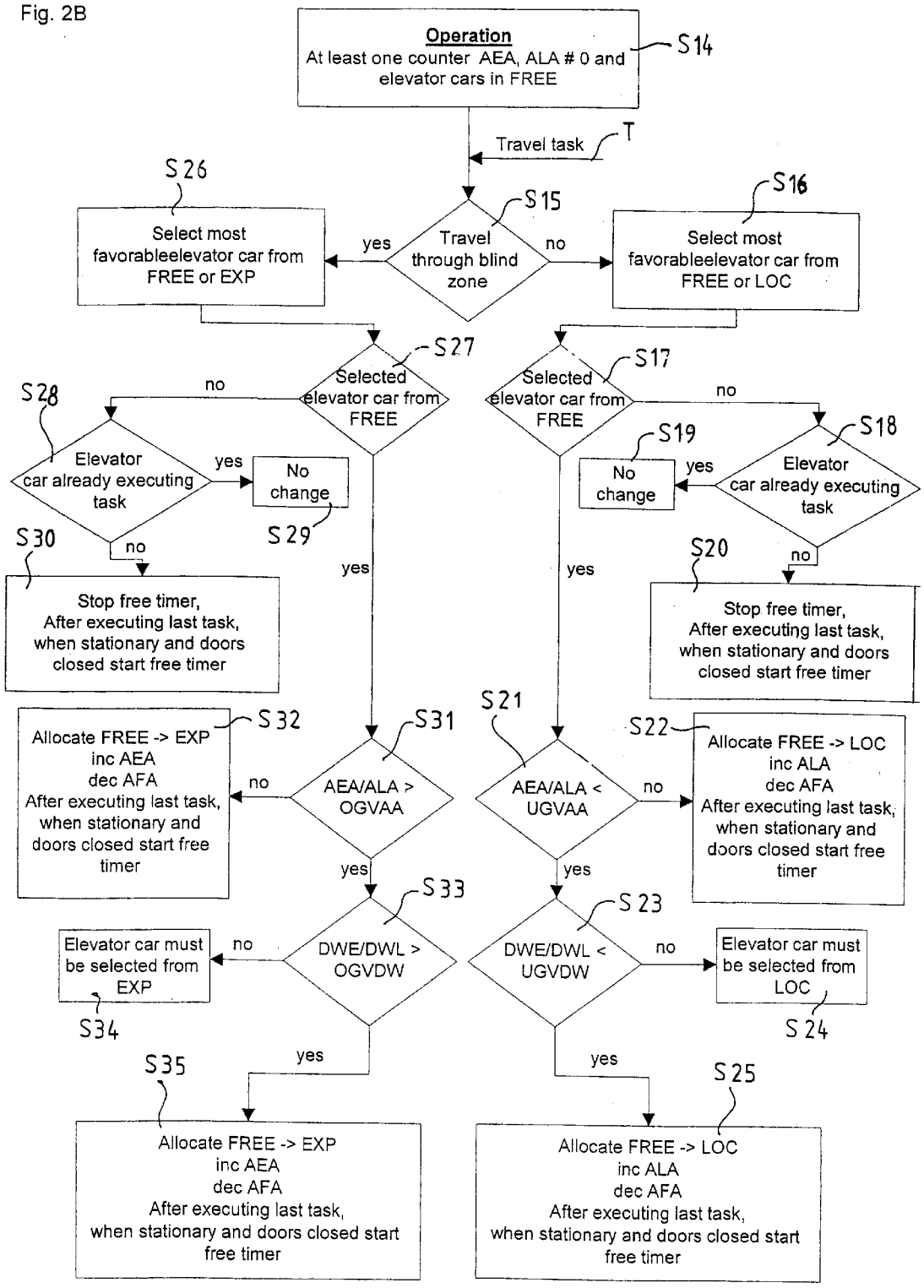
FIG. 2B is a flow diagram of an allocation algorithm according to the present invention for the case that at least one elevator car is available to the operating group for long-distance trips, or to the operating group for local trips, and at least one elevator car is available to the group for free elevator cars.

FIG. 2A shows the present invention operating status in which there is at least one elevator car in the operating group EXP or in the operating group LOC. In FIG. 2A, the method starts in a step S6 when the other elevator cars are in the FREE group. FIG. 2B shows the present invention operating status in which the elevator cars are in FREE. In FIG. 2B, the method starts in a step S14 when at least one of the counters AEA and ALA are at zero. The following description refers to both FIGS. 2A and 2B with FIG. 2B showing more detail of the method. After receipt of a travel task T, a check is made in a step S7 (step S15) as to whether a blind zone lies between the start and the destination of the travel task. If the trip does not pass through a blind zone, the method branches at "no" to a step S8 (step S16) wherein the most favorable elevator car for executing the travel task is selected from the operating groups LOC and FREE. If the selected elevator car belongs to the operating group LOC (step S17, "no" branch), a check is made whether the selected elevator car is already executing a travel task (step S18). If the selected elevator car is executing a travel task ("yes" branch), there is no change (step S19). If the selected elevator car is not executing a travel task ("no" branch, free timer is running), the free timer is stopped, and started again after the travel task has been executed (step S20).

If the selected elevator car belongs to the group for free elevator cars FREE ("yes" branch, step S17), the method enters a step S9 wherein parameters are evaluated by comparing a ratio of the number of elevator cars AEA/ALA against a lower limit value UGVAA (step S21). If the number ratio has not fallen below lower limit value UGVAA ("no" branch, step S21), the elevator car which previously belonged to the group for free elevator cars FREE is newly allocated to the operating group LOC, and the counters ALA and AFA are newly set (step S22). If the number ratio has fallen below the lower limit value UGVAA ("yes" branch, step S21), the ratio of the average waiting time DWE/DWL is compared against a lower limit value UGVDW (step S23). If the time ratio has not fallen below the lower limit value UGVDW ("no" branch, step S23), an elevator car must be selected from the operating group LOC (step S24). If the number ratio has fallen below the lower limit value UGVDW ("yes branch, step S23), the elevator car which previously belonged to the FREE group is newly allocated to the LOC operating group, and the counters ALA and AFA are newly set in a step S10 (step S25).

If the trip passes through a blind zone, the method branches at "yes" from the step S7 (step S15) and enters a step S11 (step S26) wherein the elevator car most favorably executing the travel task is selected from the operating groups EXP and FREE. If the selected elevator car belongs to the EXP operating group ("no" branch, step S27), a check is made whether the selected elevator car is already executing a travel task (step S28). If the selected elevator car is executing a travel task ("yes" branch), there is no change (step S29). If the selected elevator car is not executing a travel task ("no" branch, step S28), the free timer is stopped, and started again after the travel task has been executed (step S30).

If the selected elevator car belongs to the FREE group, the method enters a step S12 wherein parameters are evaluated by comparing the ratio of the number of elevator cars AEA/ALA against an upper limit value OGVAA (step S31). If the upper limit value OGVAA is not exceeded by the number ratio ("no" branch, step S31), the elevator car which previously belonged to the FREE group is newly allocated to the EXP operating group, and the counters AEA and AFA are newly set (step S32). If the upper limit value OGVAA is exceeded ("yes" branch, step S31), the ratio of the average waiting time DWE/DWL is compared against an upper limit value OGVDW (step S33). If the upper limit value OGVDW is not exceeded ("no" branch, step S33), an elevator car must be selected from the operating group EXP (step S34). If the upper limit value OGVDW is exceeded ("yes" branch, step S33), the elevator car which previously belonged to the FREE group is newly allocated to the EXP operating group, and the counters AEA and AFA are newly set in a step S13 (step S35).

Figure 3:
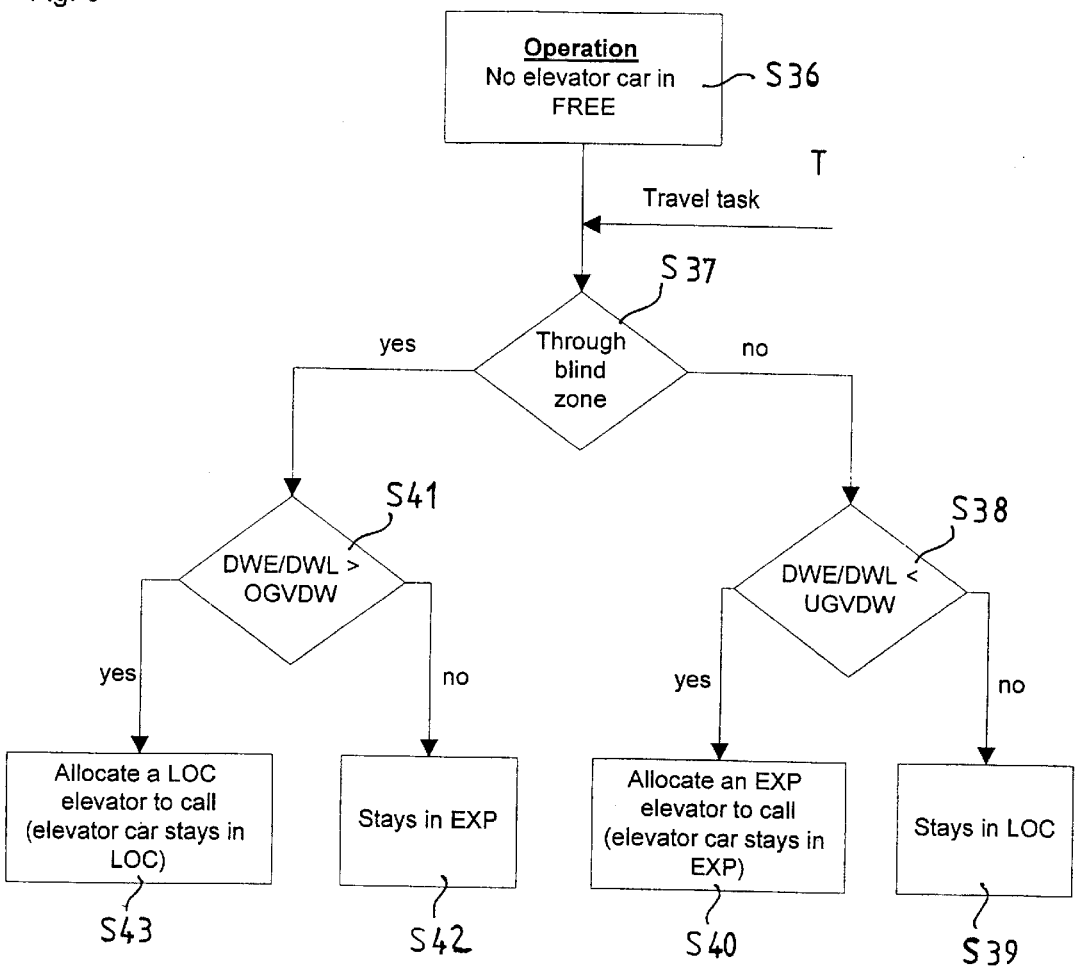
FIG. 3 is a flow diagram of an allocation algorithm according to the present invention for the case that no elevator car is available to the group for free elevator cars.

FIG. 3 shows an allocation algorithm according to the method of the present invention starting with a step S36 when no free elevator car is available. After receipt of a travel task T, a check is made in a step S37 whether a blind zone lies between the start and the destination of the travel task. If the trip does not pass through a blind zone "no" branch), the ratio for the average waiting time DWE/DWL is compared against a lower limit value UGVDW in a step S38. If the waiting time has not fallen below the lower limit value UGVDW ("no" branch), the elevator car executing the travel task remains in the LOC operating group in a step S39. If the waiting time is below the lower limit value UGVDW ("yes" branch), the travel task is executed by an elevator car from the EXP operating group, the executing elevator car continuing to remain in the operating group EXP in a step S40. If the trip passes through a blind zone ("yes" branch, step S37), the ratio of the average waiting time DWE/DWL is compared against an upper limit value OGVDW in a step S41. If the upper limit value OGVDW is not exceeded ("no" branch), the elevator car executing the travel task remains in the EXP operating group in a step S42. If the upper limit value OGVDW is exceeded ("yes" branch), the travel task is executed by an elevator car from the LOC operating group, the executing elevator car continuing to remain in the LOC operating group in a step S43. This mode of operation is explained further below with reference to FIG. 5 which is an example of a specific traffic situation.

Figure 4:
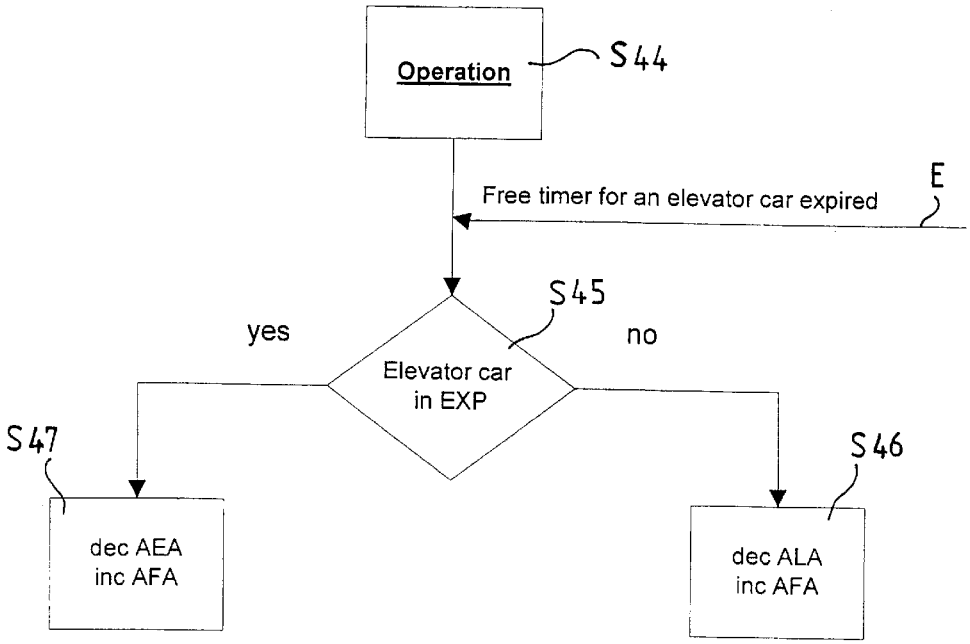
FIG. 4 is a flow diagram of an allocation algorithm according to the present invention for the case that the settable time of an elevator car with no travel task has expired.

FIG. 4 shows an allocation algorithm according to the method of the present invention starting with a step S44 wherein the settable time (free timer) of an elevator car has expired E. The respective elevator car was available to the EXP operating group, or the LOC operating group, for too long without executing a travel task. After expiry of the free timer E, the elevator car operating group is checked in a step S45. If the car is in the Free group ("no" branch), the counters ALA and AFA are reset in a step S46. If the car is in the EXP group ("yes" branch), the counters AEA and AFA are reset in a step S47. In either case, the car is made available to the FREE group.

The exemplary embodiment explained above relates to an elevator group with several elevator cars that can be allocated to the particular elevator groups. If several elevator groups work together, one elevator group can form an operating group. More than one operating group of the same type can also be provided. In buildings with no blind zones, and with, for example, two local zones, two operating groups can be provided for local trips, and one group provided for free elevator cars.

In the exemplary embodiment set forth above, the operating groups are determined according to the criterion of travel distance (long-distance trip, local trip). Instead of the travel distance, other criteria can be used such as, for example, the size or traveling speed of the elevator cars, criteria regarding safety, or division of the building among individual tenants, or particular uses of individual zones.

Furthermore, operating groups can be combined in different ways, for example to form a superordinated operating group.

Figure 5:
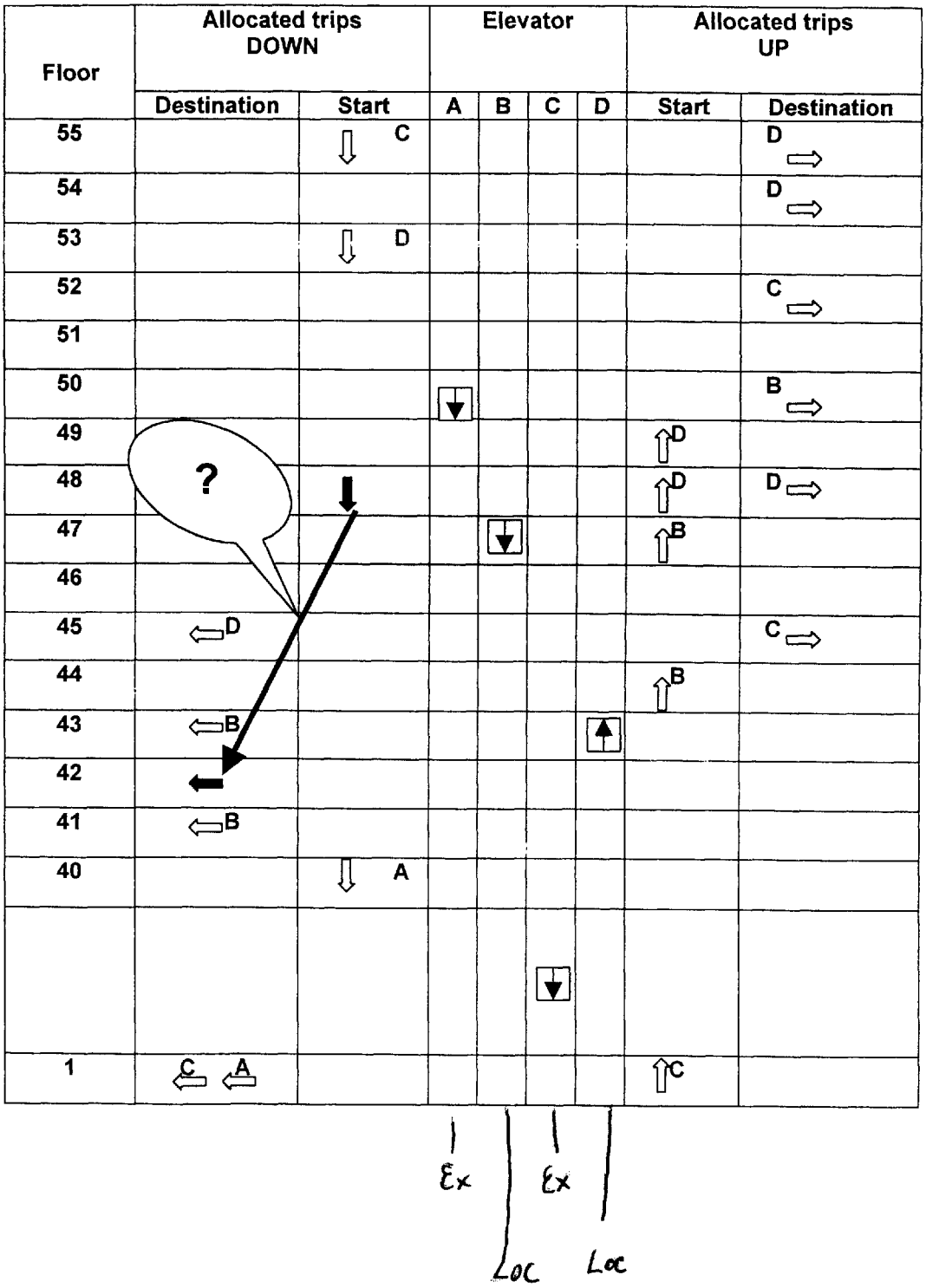
FIG. 5 is a schematic representation of an elevator group showing an example of a traffic situation for processing according to the present invention.

In FIG. 5 relates to a traffic situation for which the method according to the present invention achieves average waiting times of all operating groups which are balanced, or in a certain intended relation to each other.

FIG. 5 is a schematic representation of an elevator group. Four elevator cars A, B, C and D are controlled by a destination call control that operates according to the cost principle. To explain the control characteristic with the temporary acceptance of destination calls of another operating group, the traffic situation is considered at two different instants, "t1" and "t2".

Based on the existing passengers and the associated starting and destination floors, and the position of the elevator cars and their loading, etc., at instant "t1" the elevator cars A and C have been allocated to the operating group EXP, there being in both elevator cars passengers who are traveling downward to the main stop "1". According to the same criteria, the elevator cars B and D have been allocated to the operating group LOC.

The traffic situation and the corresponding allocation of the destination calls to the individual elevator cars at the instant "t1" are represented in FIG. 5. The elevator car A is traveling downward (momentary position: floor "50") and has already registered passengers wishing to board at the floor "40", all of whom have the main floor "1" as their destination. The elevator car C is traveling through an express zone to the main stop "1" to allow the passengers to exit and to transport the already registered passengers from the main stop "1" to the floors "45" and "52".

The elevator car B of the operating group LOC is traveling downward (momentary position: floor "47") to transport the passengers to the floors "43" and "41". Also registered for the elevator car B are passengers who wish to enter on the floors "44" and "47", all of whom wish to travel to the destination floor "50". The elevator car D of the operating group LOC is traveling upward (momentary position: floor "43") with a passenger who has input "55" as its destination floor. Further, the elevator car D has registered passengers on the floors "48" and "49" who wish to travel to the floors "54" and "55". On the floor "53" is a further passenger who is registered for the elevator car D with the destination floor "45".

At instant "t2" (immediately after the instant "t1", traffic situation and registrations unchanged) a destination call for the floor "42" is input on the floor "48". Because the cost calculation made by the elevator control indicates that the elevator cars B and D of the operating group LOC have significantly higher costs than the elevator car A of the operating group EXP, the passenger from the floor "48" to the floor "42" is assigned to the elevator car A even though in this case the travel task is for the operating group LOC.

The elevator car A remains assigned to the operating group EXP, only temporarily serving another operating group by accepting at least one travel task not of its own operating group. This results in an evening out of the waiting times in all of the operating groups.

Each elevator car of each operating group can temporarily accept travel tasks not of its own operating group, which results not only in a controlled evening out of the waiting times, but also in an increase in the transportation capacity. A desired control of the average waiting times in the individual operating groups can be achieved by means of this measure (Different average waiting times per operating group are also possible.) in accordance with the present invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of allocating a plurality of elevator cars to operating groups of a destination call control, the elevator cars of an operating group executing travel tasks for specific zones or floors, comprising the steps of:

a. providing at least two operating groups;

b. dynamically allocating each elevator car of a plurality of elevator cars to one of the at least two operating groups based upon at least one of dynamic parameters including an average waiting time, a status of a quantity counter, a ratio of the average waiting times of the at least two operating groups and a ratio of the status of the quantity counters of the at least two operating groups; and c. responding to an occurrence of a travel task by re-allocating one of the cars previously allocated to one of the operating groups to the other one of the operating groups to perform the travel task.

2. The method according to claim 1 including operating one of the elevator cars allocated to one of the operating groups to execute another travel task associated with the other one of the operating groups, without the one elevator car being allocated to the other one operating group, depending upon cost calculation for performing the another travel task.

3. The method according to claim 1 wherein a free elevator car allocated to a FREE group is re-allocated to one of the operating groups depending upon predetermined parameters of the operating group.

4. The method according to claim 3 wherein the parameters include at least one of a "Travel task through blind zone" parameter, a ratio of the number of elevator cars "AEA/ALA" parameter, and a ratio of the average waiting time "DWE/DWL" parameter.

5. The method according to claim 3 including re-allocating an elevator car allocated to one of the operating groups to the FREE group alter expiration of a predetermined time without a travel task to be performed.

6. The method according to claim 1 including providing an operating group based upon at least one of local trips, long-distance trips, a size of the elevator cars, a travel speed of the elevator cars, a safety criteria, a division of a building among individual tenants, and particular uses of individual zones.

7. The method according to claim 1 including forming a superordinated operating group from at least two of the operating groups.

8. A method of allocating a plurality of elevator cars to operating groups of a destination call control, the elevator cars of an operating group executing travel tasks for specific zones or floors, comprising the steps of:

a. providing an operating group (EXP) for long-distance trips, an operating group (LOC) for local trips, and a group (FREE) for free elevator cars;

b. dynamically allocating each elevator car of a plurality of elevator cars to one of the groups based upon at least one dynamic parameter; and c. responding to an occurrence of a travel task by re-allocating one of the cars previously allocated to one of the groups to one of the EXP and LOC operating groups to perform the travel task.

9. The method according to claim 8 including operating one of the elevator cars allocated to one of the EXP and LOC operating groups to execute another travel task associated with the other one of the operating groups, without the one elevator car being allocated to the other one operating group, depending upon a cost calculation for performing the another travel task.

10. The method according to claim 8 wherein the step c. is performed for the elevator cars allocated to the FREE group by re-allocating depending upon predetermined dynamic parameters of the EXP operating group for long-distance trips and the LOC operating group for local trips.

11. The method according to claim 10 wherein the dynamic parameters include at least one of a "Travel task through blind zone" parameter, a ratio of the number of elevator cars "AEA/ALA" parameter, and a ratio of the average waiting time "DWE/DWL" parameter.

12. The method according to claim 8 including re-allocating an elevator car allocated to one of the EXP and LOC operating groups to the FREE group after expiration of a predetermined time without a travel task to be performed.

13. The method according to claim 8 including providing an operating group based upon at least one of a size of the elevator cars, a travel speed of the elevator cars, a safety criteria, a division of a building among individual tenants, and particular uses of individual zones.

14. The method according to claim 8 including providing a plurality of operating groups and forming a superordinated operating group from at least two of the operating groups.

15. The method according to claim 1 including providing the dynamic parameters with an upper limit and a lower limit.

16. The method according to claim 15 including re-allocating one of the cars previously allocated when one of the upper limit and the lower limit is exceeded.

17. A method of allocating a plurality of elevator cars to at least two operating groups of a destination call control, elevator users communicating destination floors to the control within an access zone of the elevators, the elevator cars of an operating group executing travel tasks for specific zones or floors, comprising the steps of:

a. allocating each elevator car of a plurality of elevator cars to one of the at least two operating groups based upon at least one of the following criteria;

ii. providing an average waiting time of each of the at least two operating groups, iii. providing a status of a quantity counter of each of the at least two operating groups, iiii. determining a ratio of the average waiting times of the at least two operating groups, and iiv. determining a ratio of the status of the quantity counters of the at least two operating groups; and b. responding to an occurence of a travel task by re-allocating one of the cars previously allocated to one of the at least two operating groups to the other one of the at least two operating groups to perform the travel task.

18. The method according to claim 17 wherein a free elevator car allocated to a FREE group is re-allocated to one of the at least two operating groups depending upon predetermined parameters of the operating groups.

19. The method according to claim 18 wherein the parameters include a "Travel task through blind zone" parameter.

* * * * *